United States Patent [19]

Greenspan

[11] 4,454,962

[45] Jun. 19, 1984

[54] INSERTABLE DISPENSER

[76] Inventor: Donald J. Greenspan, 235 Pavilion Ave., Riverside, N.J. 08075

[21] Appl. No.: 330,934

[22] Filed: Dec. 15, 1981

Related U.S. Application Data

[63] Continuation-in-part of Ser. No. 228,636, Jan. 26, 1981, abandoned.

[51] Int. Cl.[3] ..... G01F 11/26

[52] U.S. Cl. ..... 221/288; 222/456

[58] Field of Search ..... 221/186, 188, 189, 191, 221/194, 288, 312 R, 312 C; 222/454, 456, 544, 546, 567; 206/528; 220/93, 233, 256, 307

[56] References Cited

U.S. PATENT DOCUMENTS

| | | | |
|---|---|---|---|
| 716,257 | 11/1902 | Lunt . | |
| 955,480 | 4/1910 | Shea . | |
| 1,352,650 | 9/1920 | Blanchard . | |
| 2,787,296 | 4/1957 | O'Malley . | |
| 2,838,214 | 6/1958 | Kimball . | |
| 2,918,167 | 12/1959 | Lowen | 221/312 R X |
| 2,957,503 | 10/1960 | Stifter . | |
| 2,962,190 | 11/1960 | Horland . | |
| 3,004,566 | 10/1961 | Raimo . | |
| 3,033,420 | 5/1962 | Thomas et al. . | |
| 3,043,483 | 7/1962 | Vogt . | |
| 3,067,787 | 12/1962 | Salk . | |
| 3,164,289 | 1/1965 | Cocchiarella | 220/93 |
| 3,182,694 | 5/1965 | Raimo . | |
| 3,205,919 | 9/1965 | Kovacs . | |
| 3,289,885 | 12/1966 | Villavaces | 221/288 |
| 3,383,013 | 5/1968 | Szokely . | |
| 3,413,975 | 12/1969 | Hein . | |
| 3,422,998 | 1/1969 | Murray | 222/567 |
| 3,473,701 | 10/1969 | Bates | 222/454 X |
| 3,480,182 | 11/1969 | Rigor . | |
| 3,610,468 | 10/1971 | Borsum | 221/288 X |
| 3,622,041 | 11/1971 | Borsum et al. . | |
| 3,637,109 | 1/1972 | Stifter . | |
| 3,638,688 | 2/1972 | Conklin et al. . | |
| 3,833,147 | 9/1974 | Borsum et al. . | |
| 4,006,557 | 2/1977 | Sawyer . | |
| 4,187,964 | 2/1980 | Bogart | 222/546 |

FOREIGN PATENT DOCUMENTS

| | | | |
|---|---|---|---|
| 963119 | 6/1950 | France . | |
| 289333 | 3/1953 | France . | |
| 359368 | 2/1962 | France . | |
| 1408749 | 7/1965 | France . | |
| 393646 | 6/1933 | United Kingdom . | |
| 612036 | 11/1948 | United Kingdom . | |
| 665182 | 1/1952 | United Kingdom | 221/288 |
| 714049 | 8/1954 | United Kingdom . | |
| 821070 | 9/1959 | United Kingdom . | |
| 875889 | 8/1961 | United Kingdom | 221/288 |
| 1066912 | 4/1967 | United Kingdom . | |
| 2050302 | 1/1981 | United Kingdom . | |

*Primary Examiner*—Joseph J. Rolla
*Assistant Examiner*—Kevin P. Shaver
*Attorney, Agent, or Firm*—Panitch, Schwarze, Jacobs & Nadel

[57] ABSTRACT

An insertable dispenser for pill bottles having a rigid annular body member with an aperture for the passage of pills. Flexible lip members extend outwardly around the periphery of the body member to allow for a snug friction fit of the body member in a pill bottle. An annular shelf disposed on the inner circumference of the member serves to capture pills passing through the aperture.

4 Claims, 5 Drawing Figures

FIG. 1
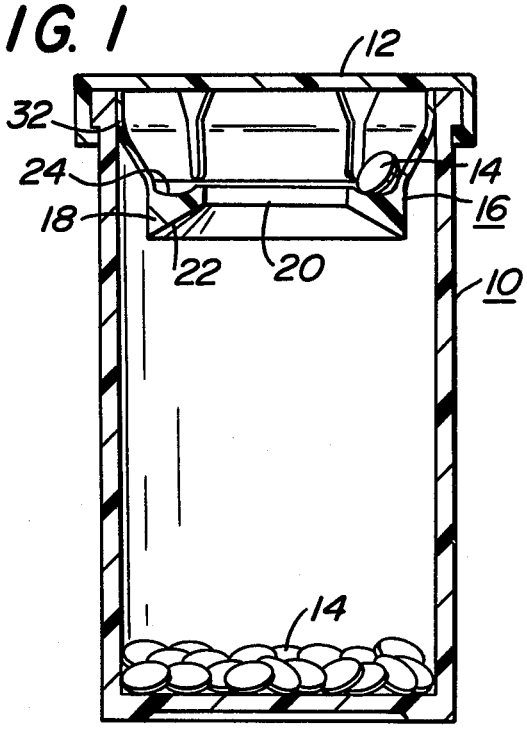
FIG. 4
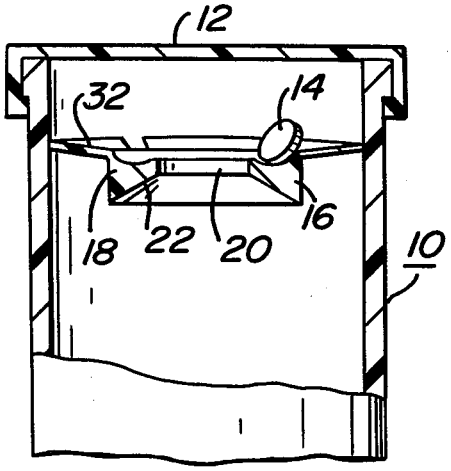
FIG. 2
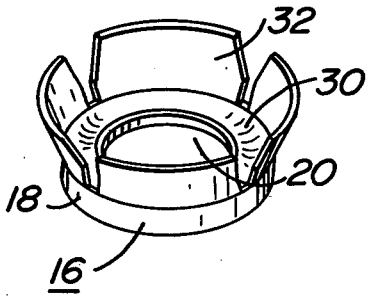
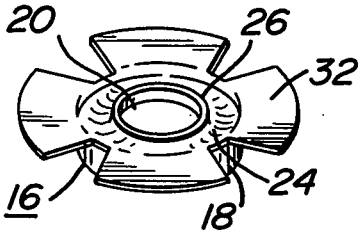
FIG. 5
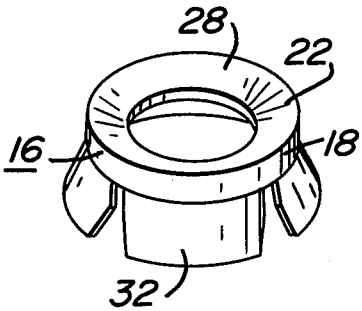
FIG. 3

INSERTABLE DISPENSER

CROSS-REFERENCE TO RELATED APPLICATION

This application is a continuation-in-part of patent application Ser. No. 228,636, filed Jan. 26, 1981, now abandoned.

BACKGROUND OF THE INVENTION

This invention relates to the dispensing of items from a coverable container. This invention also concerns relocating items in a container from a position adjacent to the bottom thereof to a position adjacent to the top thereof. More particularly, this invention concerns a dispenser apparatus that is readily adaptable for insertion in a container such as a pill bottle or vial or the cap of such container to dispense one or more pills at a time easily and without contaminating the remaining pills.

In the past decade, there has been a great deal of attention directed to developing "kiddyproof" containers for pharmaceuticals in pill, tablet, and capsule form. Accordingly, the serious problem of accidential overdosage of young children has been greatly alleviated by the proliferation of many ingenious container closures and pill dispensers.

In U.S. Pat. Nos. 3,067,787; 3,622,041; 3,637,109 and 3,833,147, resilient diaphragms with central openings are utilized in order to dispense pills. All of the devices disclosed in these patents require some manipulation and/or pressure in order to engage the pill in a socket or pocket located in the cover of the pill container. The above-described patents are more concerned with making pill containers "kiddyproof", than with making pill dispensing easier.

The problem of ease of pill dispensing is diametrically opposed to the problem of making pill containers "kiddyproof". A patient who suffers from arthritis, for example, is not so much concerned with taking an overdose of pills, as with being able to easily get a pill out of a pill bottle. It would be quite advantageous to dispense pills without having to reach down to the bottom of a bottle, or spilling out all of the pills and contaminating the same, when the patient only wants to take one or two pills. The present invention alleviates these problems and makes pill dispensing a much easier and more sanitary process.

SUMMARY OF THE INVENTION

There has now been discovered an insertable dispenser apparatus for dispensing at least one item at a time. The dispenser has a body member having at least one aperture. The aperture is at least slightly larger than the diameter of the largest item desired to be dispensed.

The body member has as shelf disposed on the inner surface of the member to retain dispensed items. The body member further has a lip with at least a portion thereof being flexible. The lip is disposed along the outer periphery of the member and extends outwardly from the body member so as to have an outer diameter greater than the outer diameter of the body member.

The radial thickness of the flexible part of the lip is substantially less than the radial thickness of the rigid annular body member. It is preferred that the shelf have a bevel such that the inner peripheral axial length of the body member is smaller than the outer peripheral axial length of the body member.

This invention also concerns an insertable apparatus for relocating one item at a time from a first location to a second location, the second location being higher than the first location. The apparatus has an upper chamber, an insertable body member adjacent said upper chamber and has at least one aperture therethrough, the aperture being slightly larger than the diameter of the largest item desired to be dispensed. The member has a shelf disposed on the inner surface of the member to retain relocated items. The member also has a lip with at least a portion thereof being flexible, the lip being disposed on the outer periphery of the member. The lip also extends outwardly from said member so as to have an outer diameter greater than the outer diameter of the member.

The radial thickness of at least the flexible part of the the lip is substantially less than the radial thickness of the member. The lower chamber contains the items in the first location to be relocated and the lower chamber is in communication with the upper chamber so as to allow passage of items between the chambers.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is an elevational view of the insertable dispenser apparatus of this invention disposed in a container.

FIG. 2 is a top perspective view of the dispenser apparatus depicted in FIG. 1.

FIG. 3 is a bottom perspective view of the dispenser apparatus depicted in FIG. 1.

FIG. 4 is an elevational view of the insertable dispenser apparatus of this invention disposed in a container wherein the lip is nearly aligned with the body of the dispenser.

FIG. 5 is a top perspective view of the dispenser apparatus depicted in FIG. 4.

DETAILED DESCRIPTION OF THE INVENTION

Although the dispenser of this invention can be utilized for a wide variety of items, it is particularly useful to dispense pharmaceuticals in the form of pills, tablets, capsules, etc. from vials and bottles. The apparatus of this invention can also serve to relocate items from a position adjacent to the bottom of a container to a new position adjacent to the top of the container for ease of removal.

Referring now to the drawings, in all of which like parts are designated by like reference numerals. The insertable dispenser 16 of this invention is particularly adapted for use as a pill dispenser and as herein described and illustrated comprises a bottle, vial, or container 10. The bottle, vial, or container 10 may be made of any suitable, well known material such as glass or plastic. The container 10 would generally be either a 7, 8, 11 or 12 dram size.

The upper end containing the opening of the container 10 can be covered by a cover (cap or lid) 12 which is openable and adapted to fit snugly over the container 10. The cover 12 is generally made of a resilient material such as a plastic. Alternatively, one's hand can operate as a cover. The bottle, vial or container 10 is adapted to contain pills 14.

Adjacent the open end of the container 10 is a dispenser 16. The dispenser 16 can be fabricated from any suitable rigid, resilient material. When used in conjunction with pharmaceuticals, the material should be sanitary to avoid contamination of the medicine. Non-limiting examples of suitable materials are plastic and rubber.

It is preferred that the outer surface 30 of the dispenser 16 have a rough texture, for example, having ridges, grooves, or undulations, to prevent the dispensed item from slipping back through the aperture 20.

The inner surface 28 of the dispenser 16 can be either straight or sloped. If sloped, the shape could be either concave or convex. A baffle (not shown) can be placed underneath the aperture 20 to further aid in the dispensing of items.

The shape of the dispenser 16 will be dictated by the shape of the container 10 it is associated with. A cylindrical container 10 would thus require a cylindrical dispenser 16.

The dispenser 16 has a rigid annular body member 18 having an aperture 20 therethrough. The aperture 20 can be positioned anywhere on this surface. It is preferred that the aperture 20 be centrally located. The aperture 20 can have any conventional shape such as circular, semicircular, truncated circular section, square, rectangular, etc. The aperture 20 can be fitted with a removble plug. Furthermore, the aperture 20 can be tapered to lead pills and especially capsules for dispensing and relocating. In a preferred embodiment, a rim 26 can be disposed around the aperture 20.

As shown, the rigid body member 18 has a bevel 22 such that its inner peripheral axial length is smaller than its outer peripheral length. The bevel 22 is at an angle from the horizontal of between about 5° and about 90° and preferably between about 10° and about 35°. The body member 18 also has an annular shelf 24 to retain dispensed pills 14.

A lip 32 with at least a portion thereof being flexible is disposed along the outer periphery of the body member 18. It is preferred that the lip 32 be composed of a number of separated sections with openings between the sections. However, thin connecting webs could exist between the sections. The lip 32 functions as a live hinge for body member 18 and can be disposed at any convenient angle such as between 90° and about 180° with respect to said body member to snugly hold the dispenser 16 in friction fit with various diameter size containers 10. Thus the lip 32 can assume positions such as those shown in FIGS. 2 and 5 and all positions therebetween, as well as a fully upright position.

The lip 32 extends outwardly from the body member 18 so as to have an outer diameter greater than the outer diameter of the body member 18. This allows the dispenser 16 to form a snug friction-fit with container 10.

If the diameter of the container 10 is approximately the same diameter size as the body member 18, the body member 18 can act as a spring to snugly friction fit the dispenser 16 in the container 10. In such case, the body member 18 would be flexible with a spring-type action. Also in such case, the lip 32 will be at approximately a right angle to the body member 18 and would form part of the internal wall of container 10.

The length of the lip 32 can serve as a locator of the dispenser 16 within the container 10. The length of the lip 32 can indicate how far the body member 18 is to be inserted from the top of container 10.

When the dispenser 16 is inserted in a container 10, pills 14 are dispensed through aperture 20 onto shelf 24 by inverting the container 10 with a cover 12 or with one's hand overlying the open end of container 10. The pill 14 then passes through aperture 20. The container 10 is then at least partially righted to allow the pill 14 to be captured on shelf 24. In some embodiments, the container can be fully righted whereas in others it is preferable to keep the container tilted (partially righted) as the pill is removed. After the container is partially or fully righted the cover 12 is removed and the dispensed pill 14 is taken off the shelf 24.

In some instances, mere inversion of the container 10 may be insufficient to displace the pill 14 through the aperture 20. Therefore, it may be necessary to slightly agitate or shake the container 10 in order to pass a pill 14 through the aperture 20.

The present invention offers many advantages. Pills can now be taken out of a vial without having to put one's fingers into the bottom of the vial and thus contaminate any of the pills. Also, people who suffer from arthritis or who would otherwise have difficulty in removing pills from bottles, can now easily take their needed medication. Furthermore, by use of this invention, the required number of pills can be dispensed thus reducing pill contamination due to the dispensing of unused pills which must be returned to the pill vial. Still further, a particular diameter size dispenser can be accommodated in various container diameter sizes depending on the length and flexible rigidity of the lips of the dispenser.

The present invention may be embodied in other specific forms without departing from the spirit or essential attributes thereof and, accordingly, reference should be made to the appended claims, rather than to the foregoing specification, as indicating the scope of the invention.

I claim:

1. An insertable dispenser for insertion of an opening in a container for dispensing at least one item at a time from the container, comprising a body member having at least one aperture therethrough, said aperture being at least slightly larger than the diameter of the largest item desired to be dispensed, said member having a shelf disposed on the outer surface of said member and said member having a lip with at least a portion thereof being flexible, said lip being comprised of a plurality of separated sections and being disposed along the outer periphery of said member at a substantially common axial position so as to have an outer diameter greater than the outer diameter of said member, said lip engaging the interior of the container in a friction fit adjacent said container opening, for snugly holding the member within the container, said shelf and said lip cooperating to form a substantially continuous supporting surface for receiving and supporting items which pass through said aperture for dispensing from the container.

2. The insertable dispenser of claim 1 wherein said aperture has a rim disposed along its periphery.

3. The insertable dispenser of claim 1 wherein the lip can be disposed at an angle between about 90° and about 180° with respect to said body member.

4. An insertable dispenser for insertion in an opening of a container for dispensing at least one item at a time from the container, comprising a body member having at least one aperture therethrough, said aperture being at least slightly larger than the diameter of the largest item desired to be dispensed, said member having a shelf disposed on the outer surface of said member to retain dispensed items and said member having a lip with at least a portion thereof being flexible, said lip being disposed along the outer periphery of said member and extending outwardly and upwardly from said member so as to have an outer diameter greater than the outer diameter of said member, said lip engaging the interior of the container in a friction fit for snugly holding the member within the container, the length of said lip being utilized to locate said body member from the top of the container.

* * * * *